US010695248B2

(12) United States Patent
Berg et al.

(10) Patent No.: US 10,695,248 B2
(45) Date of Patent: Jun. 30, 2020

(54) PATIENT SLING

(71) Applicant: Arjo IP Holding AB, Malmo (SE)

(72) Inventors: Eva Berg, Lund (SE); Anette Lindell, Flyinge (SE); Emma Olsson, Klagerup (SE)

( * ) Notice: Subject to any disclaimer, the term of this patent is extended or adjusted under 35 U.S.C. 154(b) by 0 days.

(21) Appl. No.: 16/520,567

(22) Filed: Jul. 24, 2019

(65) Prior Publication Data

US 2020/0078243 A1 Mar. 12, 2020

Related U.S. Application Data

(63) Continuation of application No. 14/387,214, filed as application No. PCT/EP2013/055167 on Mar. 13, 2013, now abandoned.

(30) Foreign Application Priority Data

Mar. 22, 2012 (EP) ..... 12160698

(51) Int. Cl.
*A61G 7/10* (2006.01)
*A61G 7/057* (2006.01)
*A47G 9/02* (2006.01)

(52) U.S. Cl.
CPC ..... *A61G 7/1051* (2013.01); *A47G 9/0238* (2013.01); *A61G 7/057* (2013.01);
(Continued)

(58) Field of Classification Search
CPC .... A61G 7/1057; A61G 7/057; A61G 7/1073; A61G 7/00; A61G 7/1001; A61G 7/1013; A61G 7/1023; A61G 7/1015; A61G 7/1049; A61G 7/1051; A61G 7/1055; A47G 9/0238
See application file for complete search history.

(56) References Cited

U.S. PATENT DOCUMENTS 1,347,413 A 7/1920 Schaefer
1,438,921 A 12/1922 King
(Continued)

FOREIGN PATENT DOCUMENTS

CA 1266449 A 3/1990
DE 19501225 A1 7/1996
(Continued)

OTHER PUBLICATIONS

International Search Report for corresponding International Patent Application No. PCT/EP2013/055167, dated Jun. 21, 2013, 2 pages.
(Continued)

*Primary Examiner* — Eric J Kurilla
*Assistant Examiner* — Amanda L Bailey
(74) *Attorney, Agent, or Firm* — The Webb Law Firm

(57) ABSTRACT

A patient transfer sheet acts as a combined sling and bed cover and includes a substantially rectangular sheet portion of a size to fit over a standard bed mattress and to which are attached a plurality of straps for coupling to a hoist. The patient transfer sheet is preferably made of a single-layered material which is breathable, strong and soft. The patient transfer sheet can act as a sling for transportation/repositioning of a patient as well as a replacement bed covering to replace conventional bed linen. The patient can thus be transported onto a bed without needing to remove the patient from the sling.

18 Claims, 5 Drawing Sheets

(52) U.S. Cl.
CPC ..... *A61G 7/1013* (2013.01); *A61G 7/1055* (2013.01); *A61G 7/1057* (2013.01); *A61G 7/1073* (2013.01)

(56) References Cited

U.S. PATENT DOCUMENTS

| | | | |
|---|---|---|---|
| 2,763,875 | A | 9/1956 | Piontkowski |
| 3,284,816 | A | 11/1966 | Laubsch |
| 3,813,712 | A | 6/1974 | Bonnin |
| 3,849,813 | A | 11/1974 | Neilson |
| 4,050,521 | A | 9/1977 | Rowan |
| 4,070,721 | A | 1/1978 | Stasko |
| 4,092,748 | A | 6/1978 | Ewers |
| 4,675,925 | A | 6/1987 | Littleton |
| 4,708,183 | A | 11/1987 | Figueroa |
| 4,744,115 | A | 5/1988 | Marchione |
| 4,822,667 | A | 4/1989 | Goad et al. |
| 4,843,665 | A | 7/1989 | Gockel et al. |
| 5,121,514 | A | 6/1992 | Rosane |
| 5,155,874 | A | 10/1992 | Kershaw |
| 5,165,122 | A | 11/1992 | Phalen |
| 5,329,655 | A | 7/1994 | Garner |
| 5,396,669 | A | 3/1995 | Nieminen |
| 5,442,821 | A | 8/1995 | Weeks |
| 5,577,281 | A | 11/1996 | Mital et al. |
| 5,615,426 | A | 4/1997 | Hokett |
| 5,638,562 | A | 6/1997 | Masoncup |
| 5,673,443 | A | 10/1997 | Marmor |
| 5,754,992 | A | 5/1998 | Melnick et al. |
| 5,920,929 | A | 7/1999 | Hensley et al. |
| 6,131,215 | A | 10/2000 | Lindell |
| 6,196,229 | B1 | 3/2001 | Piazza |
| 6,341,393 | B1 | 1/2002 | Votel |
| 6,349,432 | B1 | 2/2002 | Scordato et al. |
| 6,591,435 | B1 | 7/2003 | Hodgetts |
| 6,658,676 | B1 | 12/2003 | Persson |
| 7,676,863 | B2 | 3/2010 | Henning |
| 8,093,796 | B2 | 1/2012 | Hashizume |
| 2002/0010960 | A1 | 1/2002 | Friedrich |
| 2003/0110560 | A1 | 6/2003 | Friel et al. |
| 2004/0148699 | A1 | 8/2004 | Fernie et al. |
| 2004/0221388 | A1 | 11/2004 | Votel |
| 2005/0086740 | A1 | 4/2005 | Babjak |
| 2005/0103350 | A1 | 5/2005 | Henry |
| 2005/0132495 | A1 | 6/2005 | Girard et al. |
| 2006/0150322 | A1 | 7/2006 | Schrepfer |
| 2006/0213010 | A1 | 9/2006 | Davis |
| 2007/0022534 | A1 | 2/2007 | Richards |
| 2007/0056096 | A1 | 3/2007 | Assink |
| 2008/0209630 | A1 | 9/2008 | Kazala et al. |
| 2008/0216232 | A1 | 9/2008 | White et al. |
| 2008/0301873 | A1 | 12/2008 | White |
| 2009/0144894 | A1 | 6/2009 | Shiffert |
| 2010/0043141 | A1 | 2/2010 | Short et al. |
| 2010/0071129 | A1 | 3/2010 | Yokota |
| 2010/0199425 | A1 | 8/2010 | Lee et al. |
| 2013/0167847 | A1 | 7/2013 | Rogers |
| 2013/0227789 | A1 | 9/2013 | Olson et al. |
| 2014/0090170 | A1 | 4/2014 | Mothorn |
| 2014/0182059 | A1 | 7/2014 | Jonsson |
| 2014/0317843 | A1 | 10/2014 | Martin |
| 2015/0047120 | A1 | 2/2015 | Partridge et al. |
| 2015/0074903 | A1 | 3/2015 | Berg et al. |

FOREIGN PATENT DOCUMENTS

| | | | |
|---|---|---|---|
| DE | 29803192 | U1 | 2/1998 |
| FR | 2 403 074 | A1 | 4/1979 |
| GB | 2294883 | A | 5/1996 |
| GB | 2303331 | A | 2/1997 |
| GB | 2338700 | A | 12/1999 |
| GB | 2410193 | A | 7/2005 |
| JP | 8019578 | A | 1/1996 |
| JP | 200187324 | A | 4/2001 |
| JP | 2002065764 | A | 3/2002 |
| JP | 3121217 | U | 4/2006 |
| JP | WO2008062743 | A1 | 5/2006 |
| JP | 2006198369 | A | 8/2006 |
| JP | 2006212149 | A | 8/2006 |
| JP | 2006263314 | A | 10/2006 |
| JP | 2010252898 | A | 11/2010 |
| JP | 2010262898 | A | 11/2010 |
| WO | 0112028 | A1 | 2/2001 |
| WO | 2004050002 | A1 | 6/2004 |
| WO | 2010020818 | A2 | 2/2010 |
| WO | 2010061230 | A1 | 6/2010 |
| WO | 2013139665 | A1 | 9/2013 |

OTHER PUBLICATIONS

Nassif, Gadah Ali Abou, "Effect of Weave Structure and Weft Density on the Physical and Mechanical Properties of Micro polyester Woven Fabrics", Life Science Journal, 2012, vol. 9, No. 3, pp. 1326-1331.

Ramakrishnan, G., et al., "An Investigation Into the Properties of Knitted Fabrics Made From Viscose Microfthers", Journal of Textile and Apparel, Technology and Management, Spring 2009, vol. 6, Issue 1, pp. 1-9.

Pressure Ulcer Prevention: Quick Reference Guide, European Pressure Ulcer Advisory Panel (EPUAP) and National Pressure Ulcer Advisory Panel (NPUAP), Washington, D.C., 2009, 26 pages.

International Guideline: Pressure Ulcer Treatment Technical Report, National Pressure Ulcer Advisory Panel & European Pressure Ulcer Advisory Panel, 2009, pp. 1-168.

ArjoHuntleigh Getinge Group Maxi Transfer Sheet: Instructions for Use, Nov. 11, 2013, 36 pages.

ArjoHuntleigh Getinge Group Maxi Transfer Sheet: Setting New Lateral Transfer Standards, Apr. 28, 2014, 6 pages.

Non-Final Office Action issued for related U.S. Appl. No. 14/493,285, dated Jan. 15, 2015, 25 pages.

U.S. Census Bureau, Statistical Abstract of the United States: 2012, Oct. 2011, Cumulative Percent Distribution of Population by Weight and Sex: 2007-2008 http://web.archive.org/web20111017184749/htp://www.census.gov/compendia/statab/2012/tables/12s0210.pdf.

The American Heritage Desk Dictionary 677 and 761 (1981).

The American Heritage Desk Dictionary (1981), 304, Houghton Mifflin Company, Boston, MA.

European Search Report issued for corresponding European Patent Application No. 12160698.2, dated Aug. 9, 2012, 2 pages.

Bedding—Wikipedia, Jun. 2, 2015, http://en.wikipedia.org/w/index.php?title=Bedding&oldid=663528094.

Final Office Action issued for related U.S. Appl. No. 14/493,285 dated May 22, 2015.

Non-final Office Action issued for related U.S. Appl. No. 14/493,285 dated Oct. 23, 2015.

Final Office Action issued for related U.S. Appl. No. 14/493,285, dated Apr. 29, 2016.

Next Made 2 Measure—Base Valance Information, at https://made2measure.next.co.uk/help/basevalance (downloaded May 25, 2016).

Making a Bedding with a Valance, at https://bedding-blog.brownsofweslon.co.uk/making-a-bedding-with-valance/ (Dec. 6, 2015) (downloaded Jul. 25, 2016).

Antler Cot Fastener System Technical Service Bulletin, Mkt Lit-1168 Aug. 11, 2015 Rev. A.1 (Stryker 2015).

Banerjee, Prabir Kumar, Principles of Fabric Formation. CRC Press. Oct. 15, 2014. Google Books. Web. Oct. 25, 2016.

Braila, James G., (2007), Handbook of Manufacturing Processes—How Products, Components and Materials are Made—10. D Knitting. (pp. 392-398). Industrial Press.

"A Man's Guide to Texture, Understanding Texture in Clothing", at http://www.realmenrealstype.com/clothing-texture/ (downloaded Dec. 29, 2016).

"Textured Fabric", at http://www.insidefabric.com/c-132-textured-fabric.aspx (last visited Dec. 30, 2016).

"Cotton Fabrics", at http://www.dharmatrading.com/fabric/cotton/cotton-fabrics.html (last visited Dec. 30, 2016).

The Random House College Dictionary 182 (1984).

(56) References Cited

OTHER PUBLICATIONS

Valance Sheets Explained, at http://www.yorkshirelinen.es/index.php?option=com_content&view-article&id-92&temid=164 (downloaded May 25, 2016).
SewGuide, 17 different types of SEAMS & How to sew them, 2018, https://sewguide.com/how-to-sew-seams/ (Year: 2018).
Japanese Office Action dated Jan. 7, 2020 issued in JP application No. 2019-066484.

PATIENT SLING

CROSS REFERENCE TO RELATED APPLICATIONS

This application is a continuation of U.S. patent application Ser. No. 14/387,214, filed Sep. 22, 2014 titled "Patient Sling", which is the national phase under 35 U.S.C. § 371 of PCT International Application No. PCT/EP2013/055167, filed Mar. 13, 2013 titled "Patient Sling" and which designed the United States of America, and which claims the benefit of priority to European Patent application serial No. EP12160698.2 filed on Mar. 22, 2012 now published as EP2641578A1, the entire contents of which are hereby incorporated by reference.

FIELD

The present invention relates to a patient sling and in particular to a combined patient sling and mattress sheet.

BACKGROUND

Patient slings are known for carrying incapacitated patients from one location to another, for example from an operating theatre trolley, a wheelchair or other patient support, to a patient bed. In addition, the slings can also be used to reposition patients in bed e.g. moving up in bed or turning. Such slings need to be conformable for patient comfort and strong to be able to support the patient. Difficulties arise with the movement of incapacitated patients, particularly in transferring them onto and off the sling.

SUMMARY

The present invention seeks to provide an improved patient sling.

According to an aspect of the present invention, there is provided a combined patient sling and bed covering including a substantially rectangular sheet and a plurality of coupling elements fixed to the substantially rectangular sheet for attachment to a lifting device.

A combined patient sling and bed covering provides numerous advantages over the art, particularly in the care of incapacitated patients, by avoiding the need to transfer the patient off the sling and onto a bed, which causes difficulties for the care workers and discomfort to the patient. Furthermore, a patient can be lifted from a bed by using what in effect is the bed sheet without having to transfer the patient onto a separate sling.

Preferably, the sheet is made of a single layer of material, thereby to conform with The International Pressure Ulcer Treatment and Prevention Guidelines. The sling taught herein will therefore act as a standard bed sheet when not being used as a sling.

Advantageously, the sheet will be of a strength to be able to support the weight of a patient, in particular a weight of at least 75 kilograms and preferably a weight in excess of 100 kilograms. The sheet preferably has a length of at least 170 cm and a width of at least 70 cm. In other words, the sheet will have dimensions at least as big as a bed mattress.

In the preferred embodiment, the sheet is substantially free of surface characteristics across the majority of its extent. In other words, the sheet provides an undisturbed surface with no protrusions, no stitch lines or seams, particularly across the part of the sheet which overlies the mattress. The coupling elements and any other features of the sheet are preferably located at the edges of the sheet and in practice to lie outside of the upper surface of the sheet so as not to get caught under a laying patient.

The coupling elements are preferably disposed along longitudinal sides of the sheet and may be substantially evenly spaced along the longitudinal sides.

In an embodiment, there may be provided at least one coupling element disposed along at least one transverse side, or end, of the sheet. This coupling element would preferably be located at the foot and/or head end of the sheet and be used to support and hold the feet/legs and/or head of a patient.

Advantageously, the coupling elements include straps. The straps may be attached to the sheet, while in another embodiment the straps may be removable and attachable, for instance by hooks or the like on the sheet. Preferably, the straps are adjustable in length.

The preferred embodiment provides a reinforcement element extending along the sides of the sheet.

Advantageously, there are provided first and second side valances attached to or attachable to the longitudinal sides of the sheet. The coupling elements are advantageously accessible when the side valances are attached to the sheet. In this regard, the coupling elements may at least partially extend over the side valances.

It is preferred that the sheet is made of a breathable fabric. This may be a manmade fabric such as polyester and polyamide or a natural material such as cotton, linen/flax or silk. The sheet may be woven, knitted or a nonwoven. The sheet may be washable or non-washable, i.e. specific to a patient.

According to another aspect of the present invention, there is provided a method of moving a patient in a care environment including the steps of providing a combined patient sling and bed covering which includes a substantially rectangular sheet and a plurality of coupling elements for attachment to a lifting device; lifting the patient in the combined patient sling and bed sheet by means of a lifting device to over a bed, lowering the patient onto the bed, detaching the combined sling and bed covering from the lifting device, such that the patient comes to rest on the bed with the combined sling and bed covering acting as a bed sheet.

Preferably, the method includes the step of providing or attaching side valances to the sheet.

BRIEF DESCRIPTION OF THE DRAWINGS

Embodiments of the present invention are described below, by way of example only, with reference to the accompanying drawings, in which.

DESCRIPTION OF EMBODIMENT(S)

Figure 1:
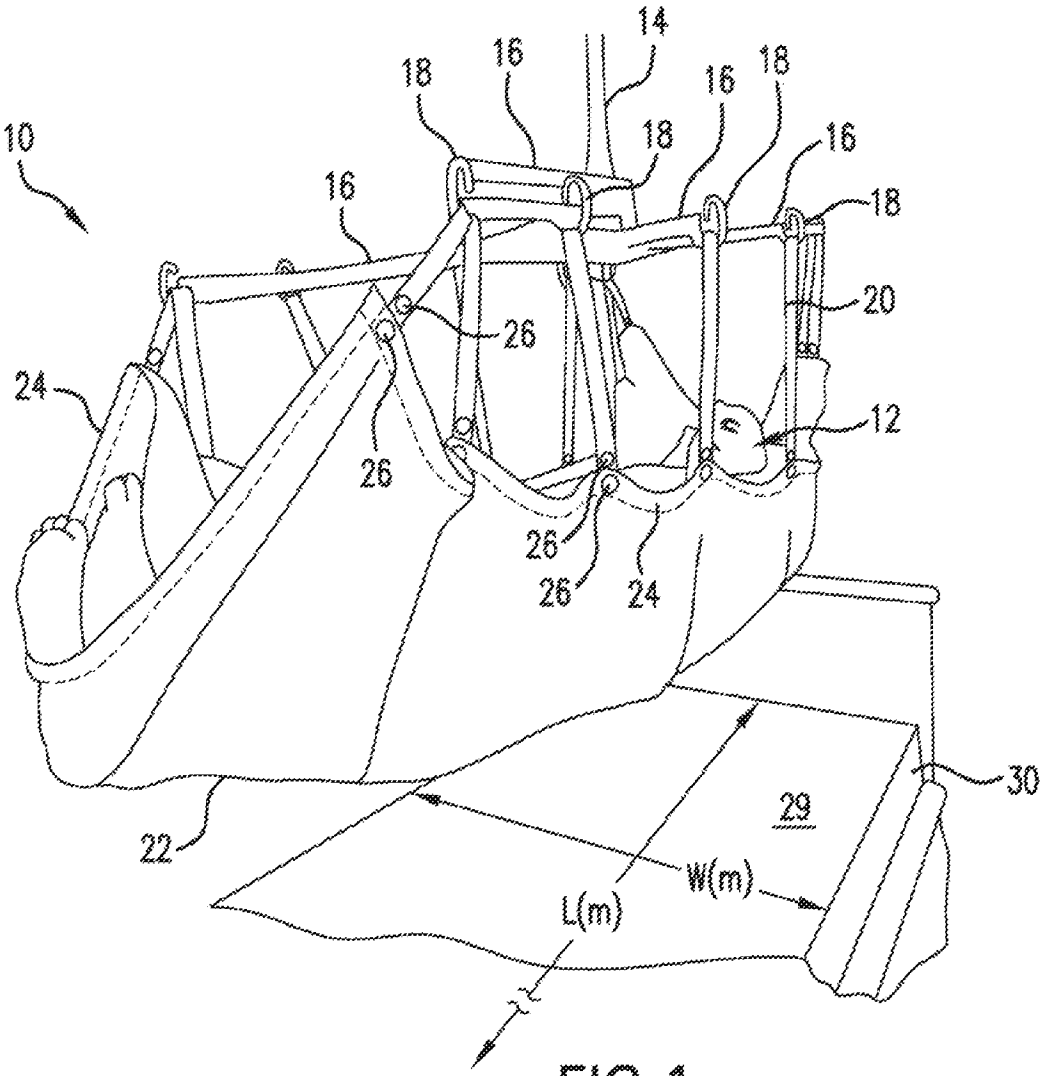
FIG. 1 is a perspective view of a preferred embodiment of patient sling and bed cover, in use.

Referring to FIG. 1, there is shown a preferred embodiment of combined sling and bed cover 10 in use and hereinafter referred to as transfer sheet 10. The transfer sheet 10 is shown holding a patient 12 in a lying position and being attached a hoist 14. The hoist 14 typically includes frame having a plurality of transversally extending arms 16 ending in hooks/lugs 18 which hold straps 20 of the transfer sheet 10. The transfer sheet 10 is preferably of dimensions that it can comfortably hold a patient 12, typically having a length of at least 170 cm and a width of at least 70 cm.

The straps 20 are preferably of a length which enables the transfer sheet 10 to hang in a substantially horizontal position with the patient 12 held inside. In order to accommodate for different designs of hoist 14 as well as different patients, the straps 20 may be adjustable in length by any well-known mechanism.

Figure 2:
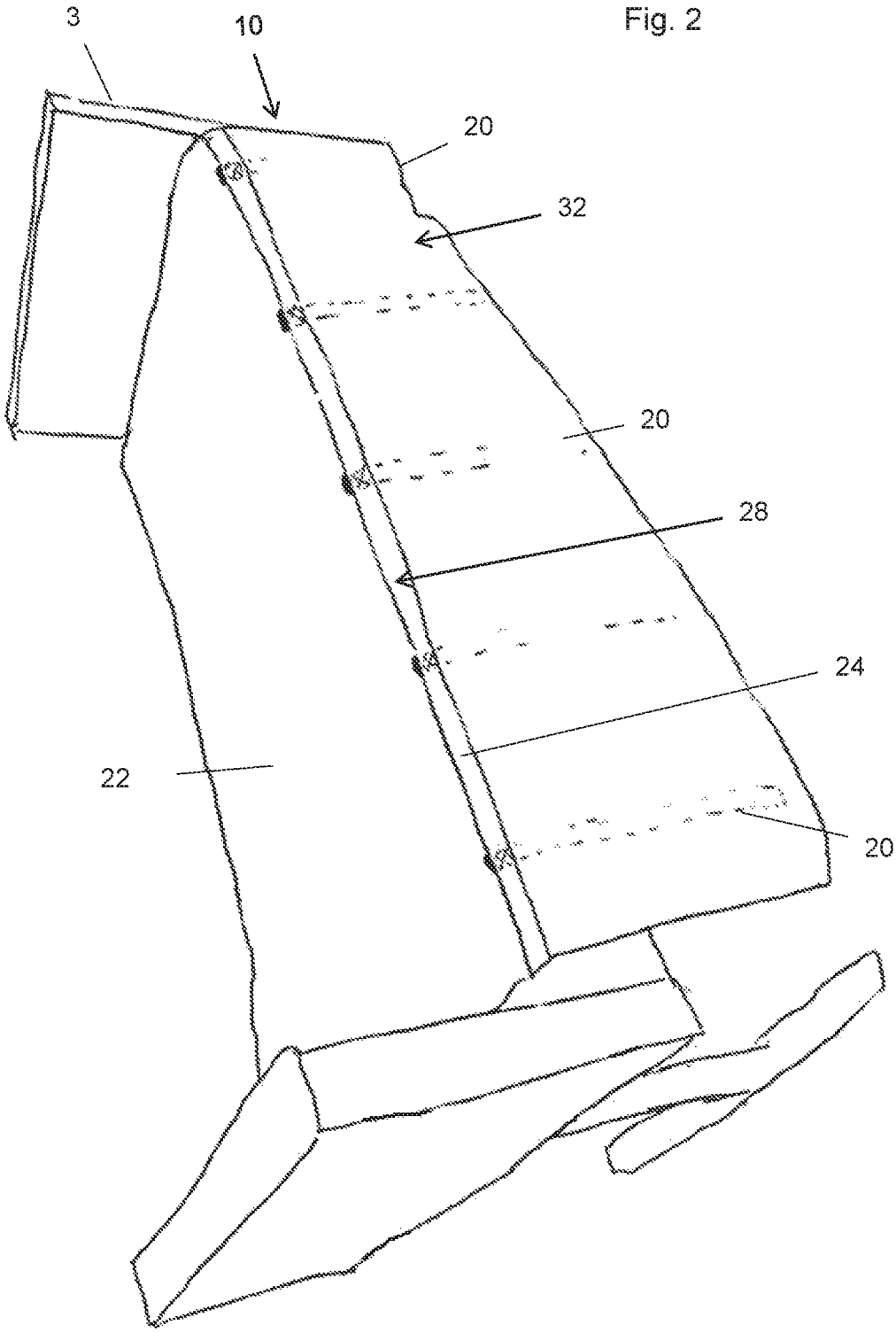
FIG. 2 is a view of the patient sling and bed cover draped over a bed.

As can be seen in particular in FIG. 1 but also with reference to FIG. 2, the transfer sheet 10 includes a first substantially rectangular sheet portion 22 which is advantageously reinforced by webbing or other material 24 extending around the perimeter of the portion 22. The webbing 24 can be stitched to the sheet portion 22 and may also be circle stitched to the straps 20 by stitching 26. Various types of stitching are disclosed below with reference to FIGS. 4 to 8.

The sheet portion 22 is preferably made of a breathable material, including man-made materials such as polyester and polyamide or natural materials such as cotton linen/flax, silk or similar. It is advantageous that the fabric have wicking properties and is also anti-static to prevent patient discomfort as well as interference with electrical equipment which may be used on, in or around the bed.

The transfer sheet 10 is made of a fabric sufficiently strong to support the weight of a patient 12, that is preferably a weight of at least 75 kg and most preferably at least 100 kg. Furthermore, as will be evident from FIGS. 1 and 2 in particular, at least the rectangular sheet element 22 is advantageously made of a drapable and smooth material, that is a material without significant burrs or other surface irregularities which may cause discomfort to a patient 12.

With reference now to FIG. 2, the transfer sheet 10 can be seen draped over a bed 30. The substantially rectangular sheet element 22 covers the entirety of the top surface of the bed 30 and in particular of a mattress provided on the bed 30. The side edges 28 of the sheet 22 and in particular the strengthening webbing 24, lie beyond the lateral extent of the bed and mattress, such that the webbing 24 and straps 20 do not cause discomfort to the patient 12 when lying on the bed. As can be seen, the substantially rectangular sheet portion 22 provides a smooth surface with preferably no stitch lines or other surface irregularities which might cause patient discomfort. The use of a material with a single layer meets the International Pressure Ulcer Treatment and Prevention Guidelines and also maximises the effect of selectively inflatable mattresses commonly used for bed ridden patients.

The transfer sheet 10 can be seen also with side valances 32 which drape from the edges of the rectangular sheet portion 22 and in particular from the webbing 24. FIG. 2 shows only one of the side valances 32, the other side valance being on the other side of the bed not visible in the view of FIG. 2. As can be seen in FIG. 2 also, the straps 20 underlie the side valances 32 so as to be substantially hidden from view when the transfer sheet 10 is draped over the bed 30. The transfer sheet 10 thus look like a normal bed sheet and act as a suitable placement. Furthermore, the side valances will prevent people and equipment from becoming caught up in the straps 20. In this regard, it is advantageous to have straps 20 which are either shorter than the drop of the side valances 32 or straps which are otherwise looped so that they do not extend below the hanging edge of the side valances 32 so that they do not drape to the floor and remain visually concealed when the transfer sheet 10 is on a bed.

In some embodiments, as shown below, the ends of the straps 20 attached to the edges of the substantially rectangular sheet portion 22 may be visible at the junction between the sheet portion 22 and the side valances 32. This can act as an indicator to a care worker that the transfer sheet 10 is not a normal bed covering but is a transfer sheet of the type disclosed therein.

Figure 3:
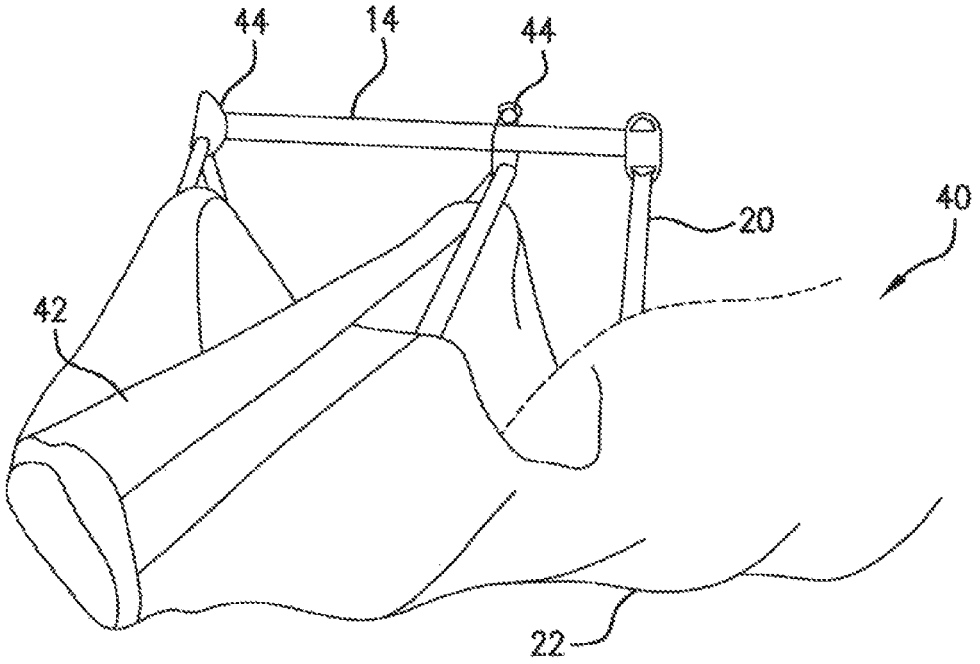
FIG. 3 is a view of a foot end of a second embodiment of combined patient sling and bed cover.

Referring now to FIG. 3 there is shown an embodiment of bed transfer sheet 40 provided with straps 20 as with the embodiment of FIGS. 1 and 2, coupled to a substantially rectangular sheet portion 22. In addition to the straps 20, the embodiment of FIG. 3 includes one or more straps 42 attached to one end of the substantially rectangular sheet portion 22 so as to act as a foot support at the foot end of the transfer sheet 10. The additional strap or straps 42 will hook into an appropriate hook/lug 44 of a hoist 14. The embodiment of FIG. 3 is otherwise the same as the embodiments of FIGS. 1 and 2. Other embodiments may have additional straps at the head end of the transfer sheet 10 or at both ends.

FIGS. 4 to 8 show different structures for the transfer sheet 10, 40 disclosed herein.

Figure 4:
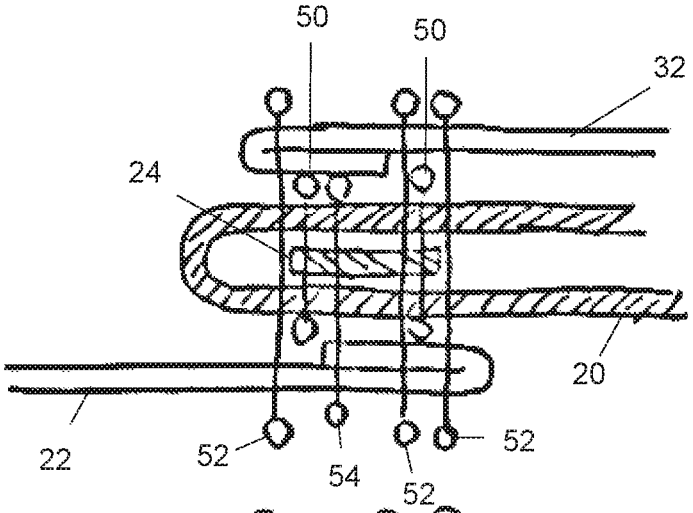
FIGS. 4 to 8 show different configurations of patient sling and bed cover.

Referring to FIG. 4 first, a portion of the substantially rectangular sheet 22 can be seen at the bottom of the Figure, while a portion of one of the valances 32 is shown at the top of the Figure and extending to the right as viewed. The strap 20 has one end which is looped around a support webbing 24 and then stitched. Stitching is applied not just through the lengths of the strap 20 and webbing 24 individually by means of sutures 50, but is applied also through the thickness of the material formed with sheet 22 and valance 32, by sutures 52. Strength can be added also by means of a suture 54 passing through the sheet 22, the strap 20 and the webbing 24. This additional stitching takes into account the fact that it is the sheet 22 which will take the weight of the patient, whereas the valances 32 will not.

In the example shown in FIG. 4, as with the other examples of FIGS. 5 to 8 equally, the strap 20 which is looped around the webbing 24 may have one end which terminates just beyond the webbing 24 such that the portion of strap 20 which is then attached to the hoist 14 is of a single thickness. In other embodiments there may be a double strap formed from both sides of the loop, in which case there may be two separate strap portions or these may be sewn together for integrity.

Of course, the sutures 50 to 54 will extend, as appropriate, along the width of the straps 20 and also across those portions of the sheet 22 and valance 32 between the straps 20 so as to secure these properly together. The stitching 50, 52 and 54 may be formed in a circle as shown in FIG. 1 and then in a line along the parts of the sheet 22 between the straps 20.

As will be apparent from FIG. 4 also, the edges of the sheet 22 and valance 32 are folded over one another to add strength to the structure.

Figure 5:
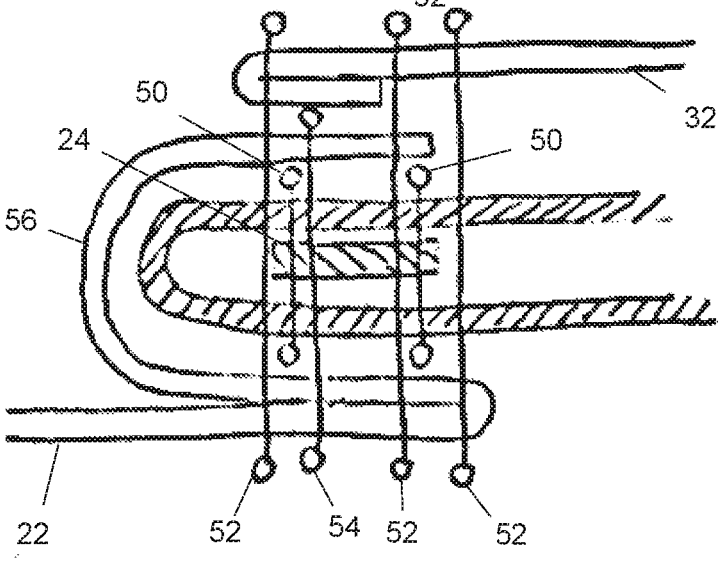

The embodiment of FIG. 5 is similar to that of FIG. 4, apart from the fact that edge 56 of the sheet 22 folds back over the sheet 22 and over the strap 20, thereby to conceal the strap 20 completely from view when the sheet and valance are draped over a bed.

Figure 6:
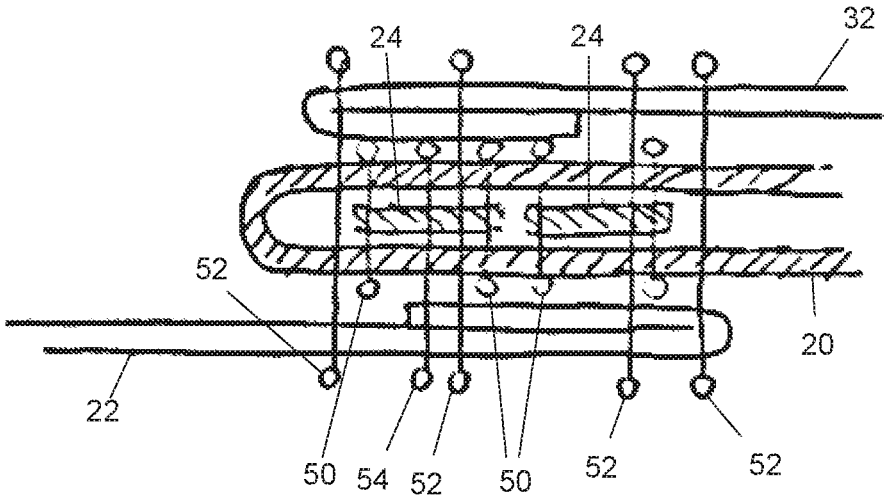

FIG. 6 shows another arrangement in which there is provided a double strengthening web 24, although in some embodiments this may be a single strengthening web 24 with apertures at regular intervals along the length of the webbing.

Figure 7:
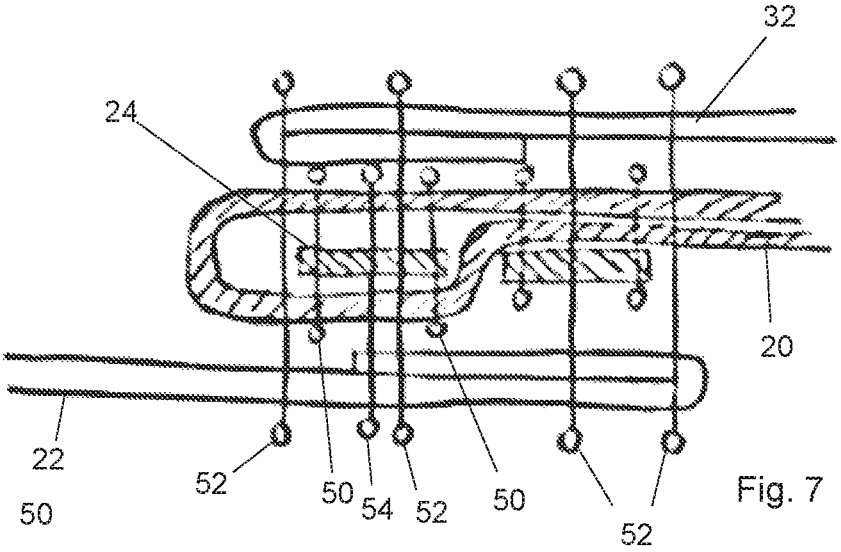

With reference to FIG. 7, this is similar to the embodiment of FIG. 6, with the primary difference being that the strap 20 has one end which passes underneath one of the webbings 24 and over the other webbing 24, as shown in FIG. 7.

Figure 8:
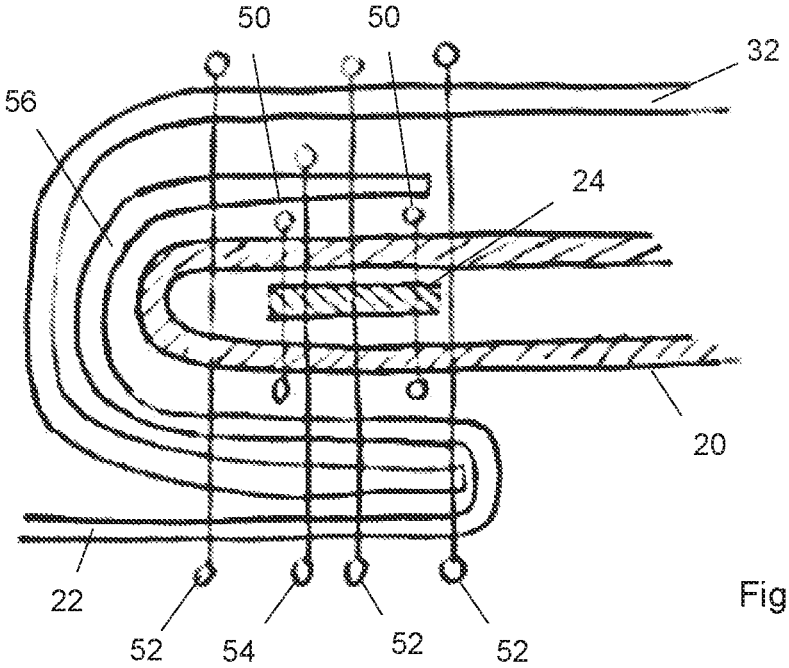

With reference to FIG. 8, this is similar to the embodiment of FIG. 5, although the edge of the valance 32 extends over the looped edge 56 of the sheet 22 in the manner shown in the Figure.

It will be appreciated that the features of the different embodiments of FIGS. 4 to 8 can be combined with one another, such as, for example, to have the arrangements or webbing and strap shown in these Figures with or without a cover provided by either the sheet 22 or the webbing 32 (the latter not shown in the drawings) or both.

In use, the transfer sheet 10 can be used both as a sling and as bed linen replacement, that is to be left underneath the patient once the patient has been transferred to a bed 30. In this regard, once the patient has been transported over the bed as shown in FIG. 1, the patient is slowly lowered onto the bed mattress and the straps are then released from the hoist 14, allowing the transfer sheet 10 to drape over the bed. The valances 32 are then draped over the bed sides to hide the straps 20, in the manner shown in FIG. 2. As the rectangular sheet portion 22 of the transfer sheet 10 provides an undisturbed flat surface, this can act as a sheet without requiring any other bed covering. In this regard, it is preferable that the bed covering includes only a single thickness of material to comply with the International Pressure Ulcer Treatment and Prevention Guidelines. This is particularly advantageous when the mattress of the bed is selectably inflatable, as is known in the art and of the types provided by the applicant.

It will be apparent that the side valances 32 are not essential to the transfer sheet but simply preferable for hiding the straps 20 and for preventing inadvertent entanglement with the straps. Although the preferred embodiments provide valances which are secured, preferably by stitching, to the sheet 22, other embodiments provide valances 32 which can be subsequently attached to the edge of the rectangular sheet 22, for example with Velcro( )™, buttons, press fasteners, zips or the like.

In the case of embodiments using additional straps as shown in FIG. 3, the patient's feet and head could be additionally supported during the transfer process.

The provision of a plurality of straps 20 which are spaced along the longitudinal sides of the rectangular sheet portion 22 enables a patient to be transported whilst lying substantially flat. They also enable the patient to be transported in a tilted or sitting position by adjustment of the lengths of the straps 20 as appropriate or by attaching only some of the straps to the hoist 14, for example by leaving the straps 20 at the foot end of the transfer sheet 10 unattached so that the patient's legs can dangle. Similarly, a tilted or sitting position of the patient can be achieved by tightening the straps 20 at the head/torso end of the transfer sheet 10. In this manner, a patient can be transported between a bed and a seat or chair and vice versa with the transfer sheet 10 and particularly by adjustment of the straps 20.

Use of transfer sheet 10, 40 avoids having to apply and remove slings or using sliding aids at each transfer, which can be uncomfortable to the patient and difficult as well as time consuming for the care giver. Moreover, the transfer sheet avoids the risk of a patient being transferred manually when sliding aids or slings are not readily available close to the patient. Furthermore, the improvement in patient handling by use of the transfer sheets 10, 40 can substantially remove or minimise the risk that tubes and feed lines attached to the patient being inadvertently removed. It will be appreciated that the transfer sheet 10, and in particular the rectangular sheet portion 22, is best made of a fabric which has similar properties to standard bed linen and in particular a fabric which is breathable and soft.

The preferred embodiment has seven straps 20 on either side of the rectangular sheet portion 22 (although only 5 are shown in the drawings). Other embodiments will be apparent to the skilled person having regard for the teachings herein and the claims which follow.

The invention claimed is:

1. A combined patient sling and bed covering comprising:

a substantially rectangular sheet of a single layer of material that is sized to fit a bed mattress, wherein one portion of the substantially rectangular sheet is constructed to overlie the bed mattress so that a majority of the substantially rectangular sheet has an undisturbed surface free of any surface characteristics selected from the group consisting of burrs, stitch lines and seams;

a plurality of coupling elements fixed to the substantially rectangular sheet for attachment to a lifting device, wherein all of the coupling elements are disposed outside the one portion of the substantially rectangular sheet that has the undisturbed surface, and wherein each coupling element includes a strap having a length; and first and second side valances attached to first and second longitudinal sides of the sheet, wherein the first side valance and the second side valance each have a length extending from the substantially rectangular sheet that is longer than the length each one of the straps has so that when that portion of the sheet that overlies the bed mattress is disposed to overlie the bed mattress, the first and second side valances drape along sides of the bed so as to completely cover one or more of the plurality of coupling elements, wherein each of the plurality of coupling elements is fixed to the sheet at one or more junctions between the sheet and one of the first side valance and the second side valance, wherein, at each junction between the sheet and the first side valance, the sheet is folded over itself and the first side valance is folded over itself, and wherein, at each junction between the sheet and the second side valance, the sheet is folded over itself and the second side valance is folded over itself.

2. A combined patient sling and bed covering according to claim 1, wherein the sheet is able to support a weight of at least 75 kilograms.

3. A combined patient sling and bed covering according to claim 1, wherein the sheet has a length of at least 170 cm and a width of at least 70 cm.

4. A combined patient sling and bed covering according to claim 1, wherein the coupling elements are disposed along longitudinal opposing sides of the sheet, and are substantially evenly spaced along the longitudinal opposing sides of the sheet.

5. A combined patient sling and bed covering according to claim 1, including at least one coupling element disposed along at least one transverse side of the sheet.

6. A combined patient sling and bed covering according to claim 1, wherein the straps are attached to a second portion of the sheet that lies beyond a lateral extent of the bed mattress when the one portion of the substantially rectangular sheet overlies the bed mattress, and the straps are length adjustable.

7. A combined patient sling and bed covering according to claim 1, further including a reinforcement element extending along two opposing sides of the sheet and wherein the reinforcement element is disposed outside the one portion of the sheet.

8. A combined patient sling and bed covering according to claim 7, wherein the reinforcement element comprises webbing disposed on side edges of the sheet and a folded over portion of the sheet.

9. A combined patient sling and bed covering according to claim 1, wherein the coupling elements are accessible when the side valances are attached to the sheet.

10. A combined patient sling and bed covering according to claim 1, wherein the sheet is made of a breathable fabric.

11. A combined patient sling and bed covering according to claim 1, wherein when the sheet is connected to the lifting device so as to lift a patient, the first and second valances are positioned to cover the patient.

12. A method of moving a patient in a care environment by deploying the combined patient sling and bed covering according to claim 1 and the lifting device, wherein the method comprises the steps of:

(a) employing the lifting device to lift the patient in the combined patient sling and bed covering to a position over the bed, and (b) lowering the patient onto the bed and detaching the combined patient sling and bed covering from the lifting device so that the patient comes to rest on the bed with the combined sling and bed covering deployed as a bed sheet that covers substantially an upper surface of the bed mattress of the bed.

13. A method according to claim 12, wherein the combined sling and bed covering includes first and second side valances attached to first and second longitudinal sides of the sheet, and the method further includes the step of:

(c) draping the first and second side valances along sides of the bed so as to completely cover one or more of the plurality of coupling elements.

14. A combined patient sling and bed covering comprising:

a substantially rectangular sheet comprising at least one layer of material and a portion constructed to overlie a bed mattress and to provide a contact surface for a patient so that a majority of the substantially rectangular sheet has an undisturbed surface free of surface irregularities including stitch lines and seams;

a plurality of coupling elements fixed to the substantially rectangular sheet for attachment to a lifting device, wherein each coupling element has a length and all of the coupling elements are disposed outside the portion of the substantially rectangular sheet that forms the majority of the substantially rectangular sheet; and at least one side valance attached to a longitudinal side of the sheet, wherein the at least one side valance has a length extending from the substantially rectangular sheet so that when that portion of the sheet that overlies a bed mattress is disposed to overlie a bed mattress, the at least one side valance drapes along a side of the bed so as to completely cover one or more of the plurality of coupling elements that are each shorter in length than the length of the at least one side valance, wherein each of the plurality of coupling elements is fixed to the sheet at one or more junctions between the sheet and one of the side valances, and where, at each junction between the sheet and one of the side valances, the sheet is folded over itself and the side valance is folded over itself.

15. A combined patient sling and bed covering according to claim 14, wherein the undisturbed surface is also free of surface irregularities that include burrs.

16. A combined patient sling and bed covering according to claim 14, wherein the material is a smooth, anti-static, wicking fabric.

17. A combined patient sling and bed covering according to claim 1, wherein the material is a smooth, anti-static, wicking fabric.

18. A combined patient sling and bed covering according to claim 14, wherein the plurality of coupling elements comprise a plurality of straps that are shorter than the length of the at least one side valance.

* * * * *